US005988978A

United States Patent [19]

Pearce

[11] Patent Number: 5,988,978

[45] Date of Patent: Nov. 23, 1999

[54] METHOD AND APPARATUS FOR BALANCING A CEILING FAN

[75] Inventor: Richard A. Pearce, Memphis, Tenn.

[73] Assignee: Hunter Fan Company, Memphis, Tenn.

[21] Appl. No.: 08/992,895

[22] Filed: Dec. 18, 1997

[51] Int. Cl.[6] ..... B63H 1/00; B64C 11/00; F03B 3/12

[52] U.S. Cl. ..... 416/145; 416/62

[58] Field of Search ..... 416/62, 5, 144, 416/145, 146 R; 73/455, 457, 458, 468, 469

[56] References Cited

U.S. PATENT DOCUMENTS

| | | | |
|---|---|---|---|
| 2,362,842 | 11/1944 | Mueller | 73/455 |
| 2,366,795 | 1/1945 | Lamoreaux | 416/145 |
| 2,426,400 | 8/1947 | Lampton et al. | 416/144 |
| 2,720,013 | 10/1955 | Clarke . | |
| 4,305,292 | 12/1981 | Felter . | |
| 4,753,573 | 6/1988 | McKnight . | |
| 4,840,650 | 6/1989 | Matherne . | |
| 5,219,454 | 6/1993 | Class | 416/145 |
| 5,256,037 | 10/1993 | Chatelain | 416/5 X |
| 5,380,156 | 1/1995 | Iacovino . | |
| 5,383,765 | 1/1995 | Baxter et al. . | |
| 5,470,203 | 11/1995 | Mori et al. . | |
| 5,470,205 | 11/1995 | Conklin, Jr. . | |
| 5,593,281 | 1/1997 | Tai | 416/145 |

FOREIGN PATENT DOCUMENTS

| | | | |
|---|---|---|---|
| 21384 | of 1913 | United Kingdom | 416/144 |
| 564609 | 10/1944 | United Kingdom | 416/144 |

*Primary Examiner*—John E. Ryznic

*Attorney, Agent, or Firm*—Garrison, Morris & Haight, PLLC

[57] ABSTRACT

A method and apparatus are provided for balancing a ceiling fan suspended from the ceiling, with the fan having a plurality of blades rotatable about a centerline axis of the fan. The method comprises the steps of attaching at least one test clip to each one of an adjacent pair of the fan blades with the fan stationary, operating the fan on high speed in a downdraft direction with the test clips attached and observing the fan wobble. These steps are repeated for each adjacent pair of blades to identify the pair of blades producing the minimum wobble. The method also includes the steps of determining the optimum radial position of each of the test clips, with respect to wobble, and replacing each clip with a balance weight secured to the corresponding blade. A test clip according to the present invention may be used, with the clip comprising upper and lower members, each having a generally D-shaped configuration, and a connecting member interconnecting the upper and lower members. When this clip is used, it is releasably attached to one of the blades with an arcuate edge portion of each of the upper and lower members extending toward the leading edge of the blade and facing into the airflow passing over the blade and the clip. The shape and placement of the clip on the blade minimizes the airflow interruption, and associated vibrations, due to the presence of the clip.

17 Claims, 8 Drawing Sheets

METHOD AND APPARATUS FOR BALANCING A CEILING FAN

BACKGROUND

1. Field of the Invention

The present invention relates generally to ceiling fans and, more particularly, to a method and apparatus for balancing ceiling fans.

2. Related Art

Ceiling fans have become an increasingly popular supplementary means of conditioning air within both commercial and residential buildings. Notwithstanding the widespread use of ceiling fans, one continuing problem which faces ceiling fan designers is the tendency of ceiling fans to "wobble", or pivot about the point of suspension, due to fan blade imbalance. Although this problem is more prevalent in ceiling fans suspended from a ceiling by a canopy and downrod arrangement, ceiling fan wobble may also exist in other configurations such as low profile ceiling fans which are mounted in close proximity to the ceiling. Fan blade imbalance and the associated ceiling fan wobble may result from a variety of discrepancies associated with the ceiling fan blades including variations in blade pitch angle, dihedral angle, uneven circumferential spacing between adjacent blade pairs, blade warpage and uneven radial spacing of the blades from the vertical axis of rotation. Ceiling fan wobble and the associated vibration creates undesirable noise, is visually distracting and may adversely affect the service life of the ceiling fan.

One known method of balancing ceiling fans includes the steps of temporarily attaching a test clip, which may resemble a "clothespin", to the leading edge of one of the fan blades, then operating the fan and observing the fan wobble. This process is repeated for each of the fan blades, with the wobble being observed during each test run of the fan. The test clip is then positioned on the leading edge of the blade producing the minimum wobble at a position adjacent the blade iron or attachment bracket. The fan is then operated several additional times, with the test clip being move radially outward on the blade by a small increment after each test run. This is repeated until the optimum radial position of the test clip, with respect to fan wobble, is determined. The test clip is then replaced with a self-adhesive balance weight applied to the top surface of the blade, along the blade centerline, at the optimum radial position identified by operating the fan with the test clip attached to one of the blades.

The foregoing trial-and-error method of balancing a ceiling fan is relatively simple and inexpensive to implement, and may be advantageously used for balancing ceiling fans having an even number of fan blades, such as four blades. However, this method is less effective in balancing ceiling fans having an odd number of blades, such as five blades. For instance, if one of the five blades is heavy, there is no blade diametrically opposed to the heavy blade. Accordingly, if the foregoing balancing method is completed, it is very likely that the ceiling fan will still experience wobble. Although it is known to repeat the process and add a balance weight to a second blade, the identification of the second blade may be time consuming and may not yield the optimum results. Since the application of a weight to the first blade is inherently deficient with respect to balancing a fan having an odd number of blades, it is difficult to overcome this built-in error and to identify the proper blade, and radial position on the blade, for attachment of a second balance weight.

Another disadvantage of the foregoing method is the shape and placement of the test clip on the blade. The known test clip which is commonly used does not have an aerodynamic shape but instead may resemble a clothespin as mentioned previously and therefore may create a relatively significant interruption of the airflow passing over the blade. This problem of airflow disturbance is amplified by placing the clip on the leading edge of the blade, rather than on the trailing edge of the blade, for instance. Accordingly, airflow-induced vibrations may occur which may mask the optimum position for placement of the test clip and balance weight. Yet another disadvantage of the foregoing method of balancing ceiling fans is that the test runs of the ceiling fan are conducted with the test clip positioned on the leading edge of the blade but the replacement balance weight is attached to the blade along the blade centerline. Accordingly, even if the balance weight is attached at the radial position identified by the test clip and has about the same weight as the test clip, the balancing effect of the test clip may not be duplicated.

Other known methods of balancing ceiling fans include attaching an annular ring to the ceiling fan, with the ring having a cavity containing a variety of weights, or attaching an annular tube containing a viscous fluid to the ceiling fan, with the weights or fluid being distributed by centrifugal force and counteracting any rotational imbalance in the fan. However, these devices add weight, cost and complexity to the fan, and may not be visually appealing. In view of the foregoing deficiencies associated with known methods of balancing ceiling fans, there remains a need for a simple, economic and efficient method and apparatus for balancing ceiling fans.

SUMMARY

In view of the foregoing needs, the present invention is directed to a simple, cost effective and efficient method and apparatus for balancing a ceiling fan having a plurality of rotatable blades. Although the method of the present invention may be efficiently and advantageously utilized on any ceiling fan, regardless of configuration or the number of fan blades, the method of the present invention is particularly useful in balancing ceiling fans having an odd number of fan blades. The method of the present invention does not require an expensive and complex addition to the fan, but instead uses inexpensive plastic test clips to determine the optimum locations for applying self-adhering balance weights to an adjacent pair of the fan blades. Test runs of the fan are conducted to determine the locations for attachment of the weights, with the ceiling fan being operated on high speed, in a downdraft direction, for each test. A test clip is temporarily attached to each one of an adjacent pair of the blades for each test. Once the optimum position for weight attachment has been identified, with respect to minimizing ceiling fan wobble, the test clips are replaced with the balance weights. The weights are attached to an upper surface of each of the pair of blades and are therefore not visible to the user. Although the method of the present invention may be used in conjunction with known test clips, even greater advantages may be realized by using the method of the present invention in conjunction with the test clip of the present invention, due to the aerodynamic design of the improved test clip.

According to a first aspect of the present invention, a method is provided for balancing a ceiling fan suspended from a ceiling, with the fan having a plurality of rotatable blades. According to a preferred embodiment, the method comprises the steps of releasably attaching at least one test clip to each one of an adjacent pair of the fan blades, with the fan being stationary, operating the ceiling fan on high speed in a downdraft direction with the test clips attached to the adjacent pair of fan blades and observing the ceiling fan wobble during the operating step. The steps of releasably attaching, operating and observing are repeated for each remaining adjacent pair of the fan blades and the adjacent pair of fan blades producing the minimum ceiling fan wobble is identified.

The step of releasably attaching comprises the step of releasably attaching at least one test clip proximate a trailing edge of each one of the adjacent pair of fan blades, and preferably comprises the steps of releasably attaching a first test clip proximate a trailing edge of one of the adjacent pair of fan blades and releasably attaching a second test clip proximate a trailing edge of the other of the adjacent pair of fan blades. Both the first and second test clips may be located at a mid-span position along the trailing edge of the corresponding fan blade.

The method further comprises the step of determining the optimum radial position of each of the test clips, with respect to ceiling fan wobble, which may be accomplished as follows. The first test clip is releasably attached to one of the pair of fan blades identified as producing the minimum ceiling fan wobble, and the second test clip is releasably attached to the other of the identified pair of blades. Both the first and second clips are attached at a first radial position proximate the trailing edge of the corresponding blade. The operating and observing steps are repeated for each of a plurality of radial positions of the first test clip proximate the trailing edge of one of the identified adjacent pair of blades, while leaving the second test clip at the first radial position of the other blade of the identified pair of adjacent blades. The radial position of the first test clip resulting in the minimum ceiling fan wobble is then identified. The second test clip is then repositioned to at least one additional radial position along the trailing edge of the corresponding fan blade and the operating and observing steps are repeated with the first test clip remaining at the optimum radial position, so as to identify the optimum radial position of the second test clip, resulting in the minimum ceiling fan wobble.

The method further includes the step of replacing each of the test clips with a balance weight, preferably having a weight substantially equal to one of the test clips, secured to the corresponding one of the identified adjacent pair of fan blades, at the optimum radial position resulting in the minimum ceiling fan wobble.

According to a second aspect of the present invention, a test clip is provided which may be used in conjunction with the method of the present invention for balancing a ceiling fan suspended from a ceiling. According to a preferred embodiment, the test clip comprises generally D-shaped upper and lower members, each having an upper surface, a lower surface and a peripheral edge extending between the upper and lower surfaces. The upper and lower members are preferably substantially aligned with one another. The edge of both the upper and lower members includes an arcuate portion and a substantially straight portion, which are preferably oriented on one of the blades as subsequently discussed.

The test clip further includes a connecting member interconnecting the upper and lower members, with the connecting member defining a free-state spacing between the lower surface of the upper member and the upper surface of the lower member. The connecting member is preferably disposed proximate the substantially straight portions of the edges of the upper and lower members, and is preferably made as a one-piece construction with the upper and lower members.

The upper and lower members and connecting member are made of an elastic material, preferably a plastic material, and are configured to permit the upper and lower members to be sufficiently spaced from one another to releasably attach the test clip to one of the blades proximate one of the leading and trailing edges, preferably the trailing edge, of the blade. The free state-spacing has a minimum value which is less than the thickness of the blades so that the upper and lower members of the test clip apply a clamp load to the blade to which the clip is releasably attached. The test clip is preferably located on one of the blades so that the substantially straight portions of the upper and lower members are substantially parallel with the trailing edge of the blade and the arcuate portions of the edges extend toward the leading edge of the blade. This positioning minimizes the airflow interruption and associated vibration, as the airflow passes over the blade and the test clip.

BRIEF DESCRIPTION OF THE DRAWINGS

These and other features, aspects, and advantages of the present invention will become better understood with regard to the following description, appended claims and accompanying drawings, wherein:

DETAILED DESCRIPTION

Figure 1:
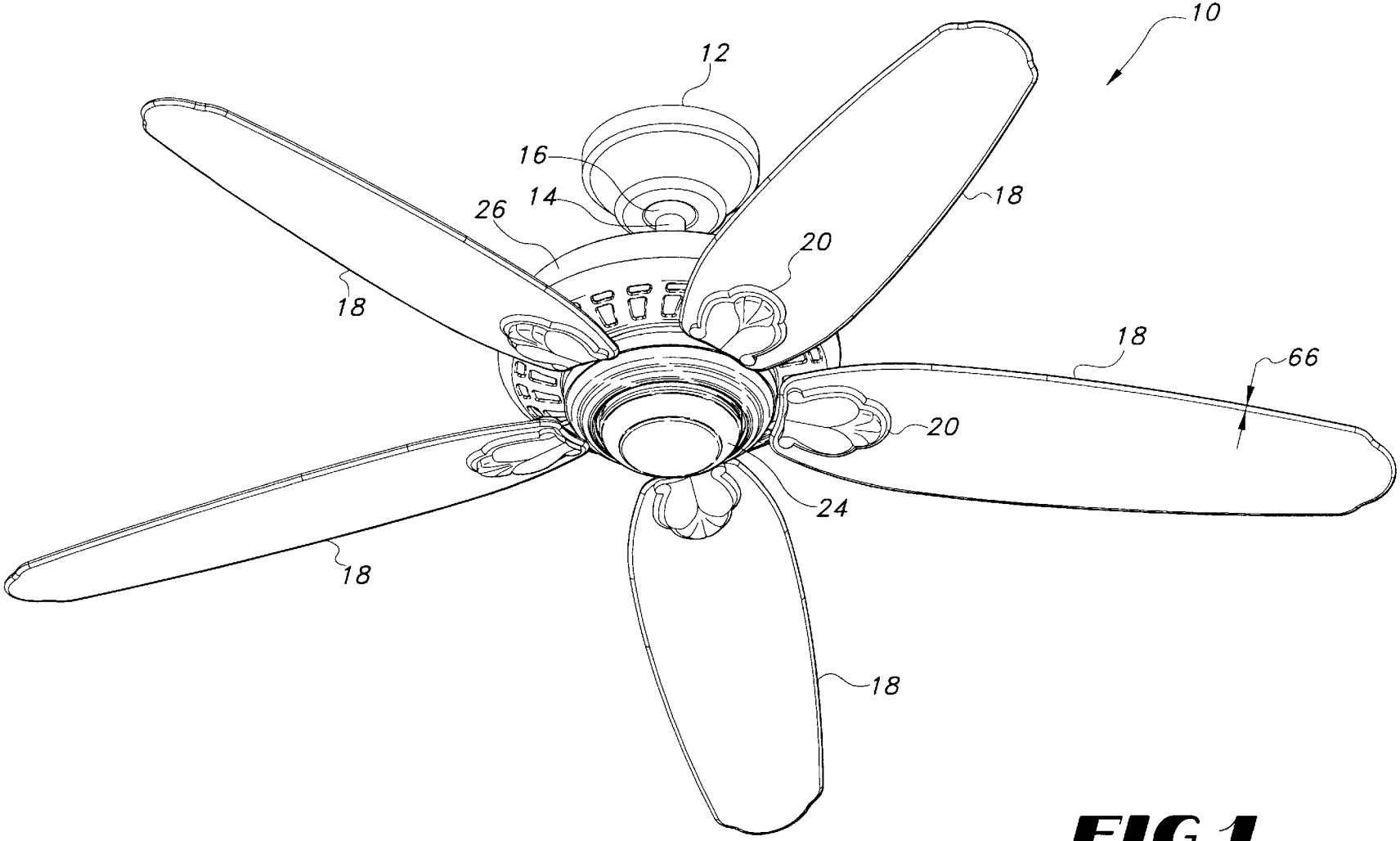
FIG. 1 is a perspective view illustrating a ceiling fan which may be balanced using the method and apparatus of the present invention.

Referring now to the drawings, FIG. 1 is a perspective view of a ceiling fan 10 which is suspended from a ceiling (not shown) and may be balanced using the method and apparatus of the present invention. Ceiling fan 10 includes a canopy 12 which is attached by conventional means such as hooks or tabs (not shown) to a ceiling mount plate (not shown) affixed to the ceiling. Ceiling fan 10 further includes a downrod 14 which is pivotally suspended from canopy 12 via a ball 16 which is threaded onto an upper end of the downrod 14 and disposed within canopy 12. The ball is pinned to canopy 12 in a conventional manner so that the ball 16 and downrod 14 are free to pivot in any direction but are restrained from rotating about a vertical axis (not shown) passing through the center of downrod 14. In the illustrative embodiment, ceiling fan 10 includes an "inside-out" electric motor (not shown) which is suspended from the downrod 14. The motor includes a centrally disposed stator fixedly mounted on a stator shaft which is threaded, at an upper end, to a lower end of the downrod 14. The stator, as is well known, is typically formed from a stack of electrical steel laminations and includes the motor windings. An annular rotor is concentrically positioned about the stator and is also formed from a stack of electrical steel laminations, as is well known. During operation of the ceiling fan 10, the rotor rotates about the stator and stator shaft. The ceiling fan motor further includes a two-piece motor casing comprising upper and lower end covers or bells which are affixed by any suitable means to the rotor.

A plurality of fan blades 18 are mounted to the rotating portion of the ceiling fan motor for rotation therewith during operation of fan 10. In the illustrative embodiment, the blades 18 are mounted to the lower end cover (not shown) of the motor casing via mount brackets 20 (one for each blade 18) and a blade ring (not shown) which is attached to the rotatable lower end cover of the motor casing. Each of the blades 18 is fastened to one of the mount brackets 20 which may be integrally formed with the blade ring.

Ceiling fan 10 further includes a switch housing (not shown) which is supported by the stator shaft and includes one or more electric switches as required to control the speed and direction of the ceiling fan motor and blades 18. Fan 10 further includes a decorative switch housing cover 24 disposed in surrounding relationship with the switch housing and a decorative motor housing 26 disposed in surrounding relationship with the ceiling fan motor. Both the housings 24 and 26 are supported by the stator shaft. Fan 10 may optionally include a light fixture (not shown) suspended below the switch housing cover.

It should be understood that ceiling fan 10 is illustrative of a ceiling fan which may incorporate the method and apparatus of the present invention. However, the particular features of ceiling fan 10 do not comprise a portion of this invention and it should be further understood that the subsequently described method and apparatus for balancing a ceiling fan may be used in conjunction with a wide variety of ceiling fans other than fan 10. For instance, the method and apparatus of the present invention may be used with ceiling fans having other numbers of blades, including those having even numbers of blades, with the blades being attachable to either an inside-out or standard arrangement motor (with the stator disposed around the rotor) by means other than the mount brackets 20 and the blade ring described previously. The alternate blade mounting means may include, but are not limited to attachment ramps or wedges affixed to the fan motor. Furthermore, the method and apparatus of the present invention may be used in conjunction with fans which are not suspended from the ceiling with a canopy and downrod arrangement, but instead are mounted in close proximity to the ceiling, with these fans being referred to as "low profile" or "hugger" type ceiling fans.

Ceiling fan 10 may wobble or pivot about the ball 16 during operation, due to imbalance of one or more of the fan blades 18. This fan blade imbalance and the associated ceiling fan wobble may result from a variety of discrepancies associated with the fan blades 18 including variations in blade pitch angle, dihedral angle, uneven circumferential spacing between adjacent pairs of blades 18, blade warpage and uneven radial spacing of blades 18 from a vertical axis of rotation (not shown). The ceiling fan wobble and the associated vibration creates undesirable noise, is visually distracting and may adversely effect the life of ceiling fan 10. The subsequently described method and apparatus of the present invention may be used to balance ceiling fan 10 and significantly reduce or substantially eliminate the wobble of ceiling fan 10.

FIGS. 2–6 illustrate a test clip 30 according to the present invention which may be used with the subsequently described method of the present invention for balancing ceiling fan 10 or other ceiling fans. Test clip 30 is releasably attachable to one of the blades 18 and includes a generally D-shaped upper member 32 and a generally D-shaped lower member 34 which are spaced apart from one another and are preferably aligned with one another. The upper member 32 includes an upper surface 36, a lower surface 38, and a peripheral edge 40 extending between the upper 36 and lower 38 surfaces and forming a perimeter of the upper member 32. Similarly, the lower member 34 has an upper surface 42, a lower surface 44 and a peripheral edge 46 extending between the upper 42 and lower 44 surfaces and forming a perimeter of the lower member 34.

The test clip 30 further includes a connecting member 48 interconnecting the upper 32 and lower 34 members of the test clip 30. The connecting member 48 defines a free-state spacing 50 between the lower surface 38 of the upper member 32 and the upper surface 42 of the lower member 34 of clip 30. The upper member 32, lower member 34 and the connecting member 48 are made of an elastic material, preferably a plastic material, and are configured to permit the clip 30 to be releasably attached to one of the blades 18, preferably proximate the trailing edge of blade 18 as subsequently discussed. The upper member 32, lower member 34 and connecting member 48 are preferably made as a one-piece construction.

Figure 2:
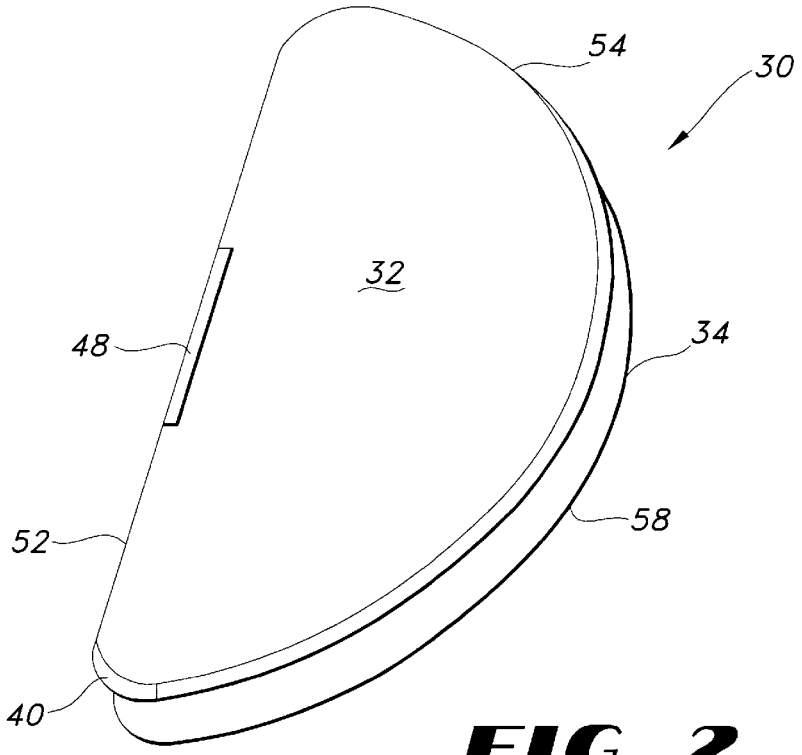
FIG. 2 is a perspective view of a test clip which may be used in conjunction with the method of the present invention.
Figure 3:
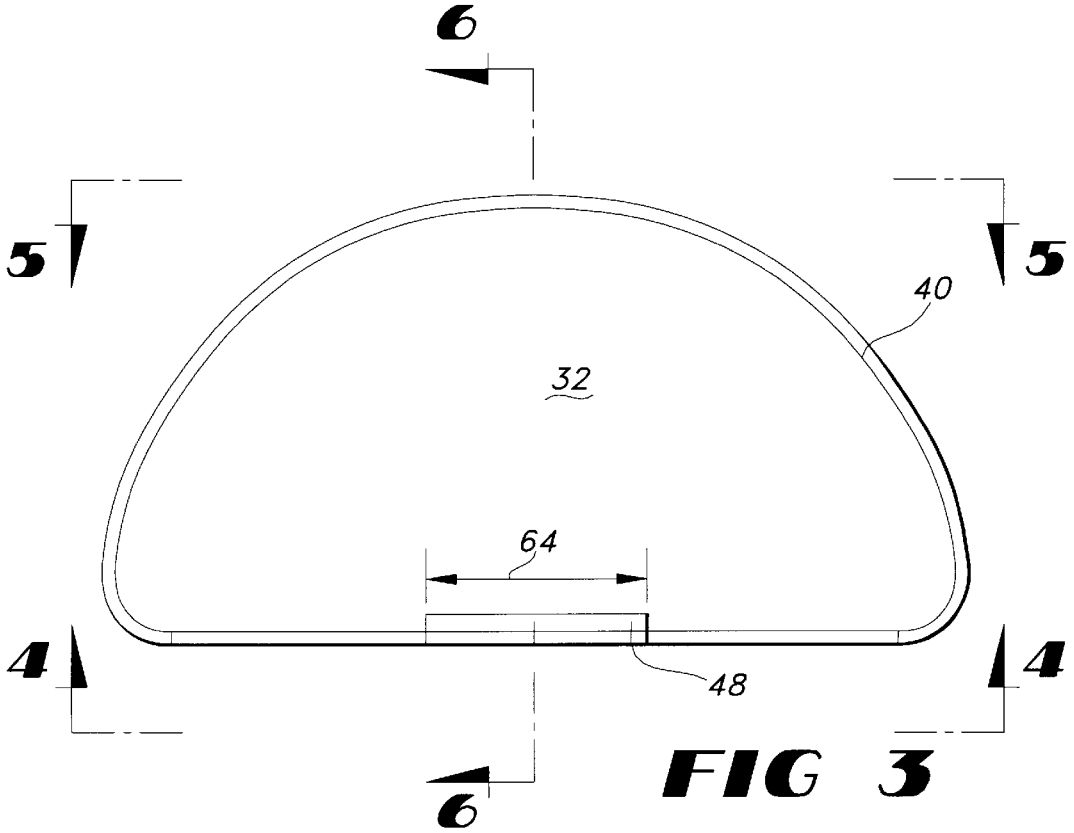
FIG. 3 is a top plan view of the test clip shown in FIG. 2.
Figure 4:
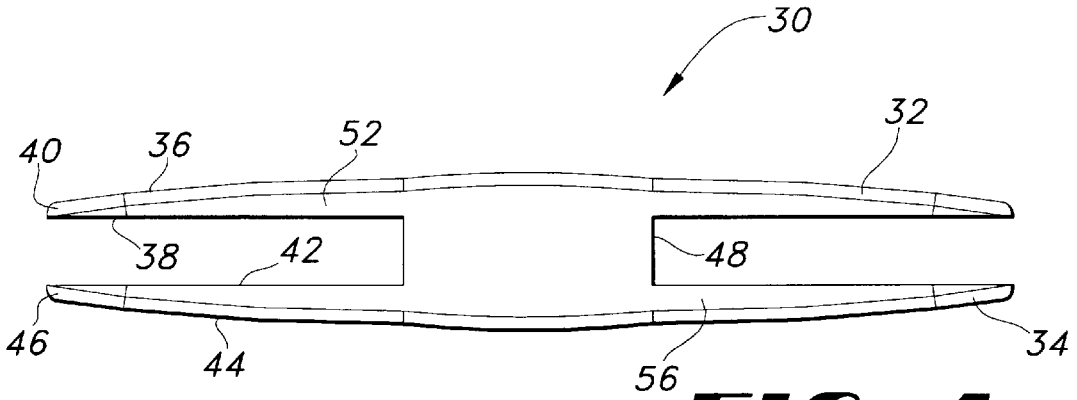
FIG. 4 is a side elevation view taken along line 4—4 in FIG. 3.
Figure 5:
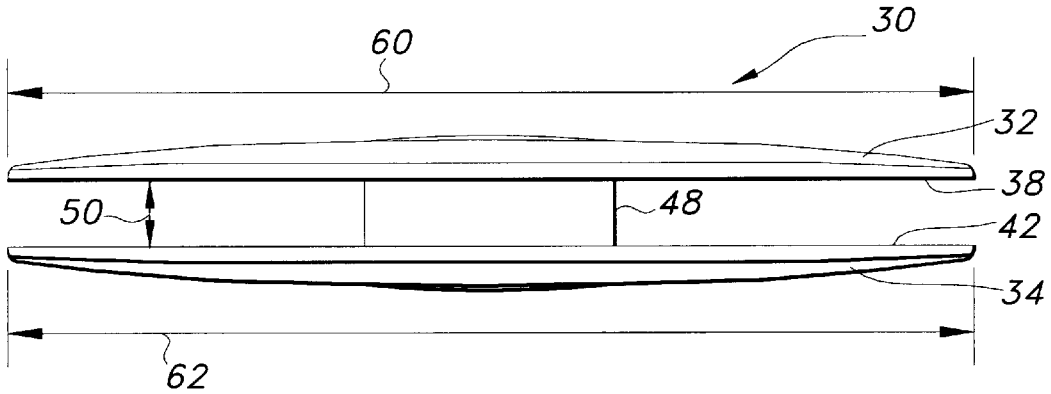
FIG. 5 is a side elevation view taken along line 5—5 in FIG. 3.
Figure 6:
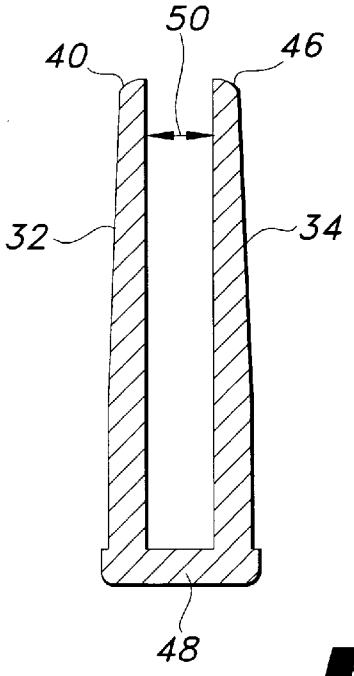
FIG. 6 is a cross-sectional view taken along line 6—6 in FIG. 3.

As shown in FIGS. 2 and 3, the edge 40 of the upper member 32 of clip 30 includes a substantially straight portion 52 and an arcuate portion 54 as viewed in plan. Similarly, although not shown in plan view, the edge 46 of the lower member 34 includes a substantially straight portion 56 and a substantially arcuate portion 58. The connecting member 48 interconnects the substantially straight portions 52 and 56 of members 32 and 34, respectively and is preferably generally centrally disposed relative to the substantially straight portions 52 and 56. The upper member 32 has a maximum width 60 and the lower member 34 has a maximum width 62 which is preferably substantially the same as the maximum width 60 of member 32. The connecting member 48 has a width 64 which is substantially less than the widths 60 and 62. Preferably width 64 is less than one-half of either width 60 or width 62 and even more preferably is less than about one-third of either width 60 or width 62. The relative size and positioning of connecting member 48 with respect to the upper 32 and lower 34 members, coupled with the elastic material used to construct the upper member 32, lower member 34 and connecting member 48, permit the test clip 30 to be releasably attached to one of the blades 18. More particularly, the upper 32 and lower 34 members may be forced apart locally by a distance which exceeds a thickness 66 of each of the blades 18. The free-state spacing 50 between the lower surface 38 of the upper member 32 and the upper surface 42 of the lower member 34 is preferably substantially uniform throughout clip 30. The minimum value of spacing 50 is less than the thickness 66 of blades 18, causing the upper 32 and lower 34 members to apply a clamp load to the blade 18 to which clip 30 is releasably attached.

Figure 7:
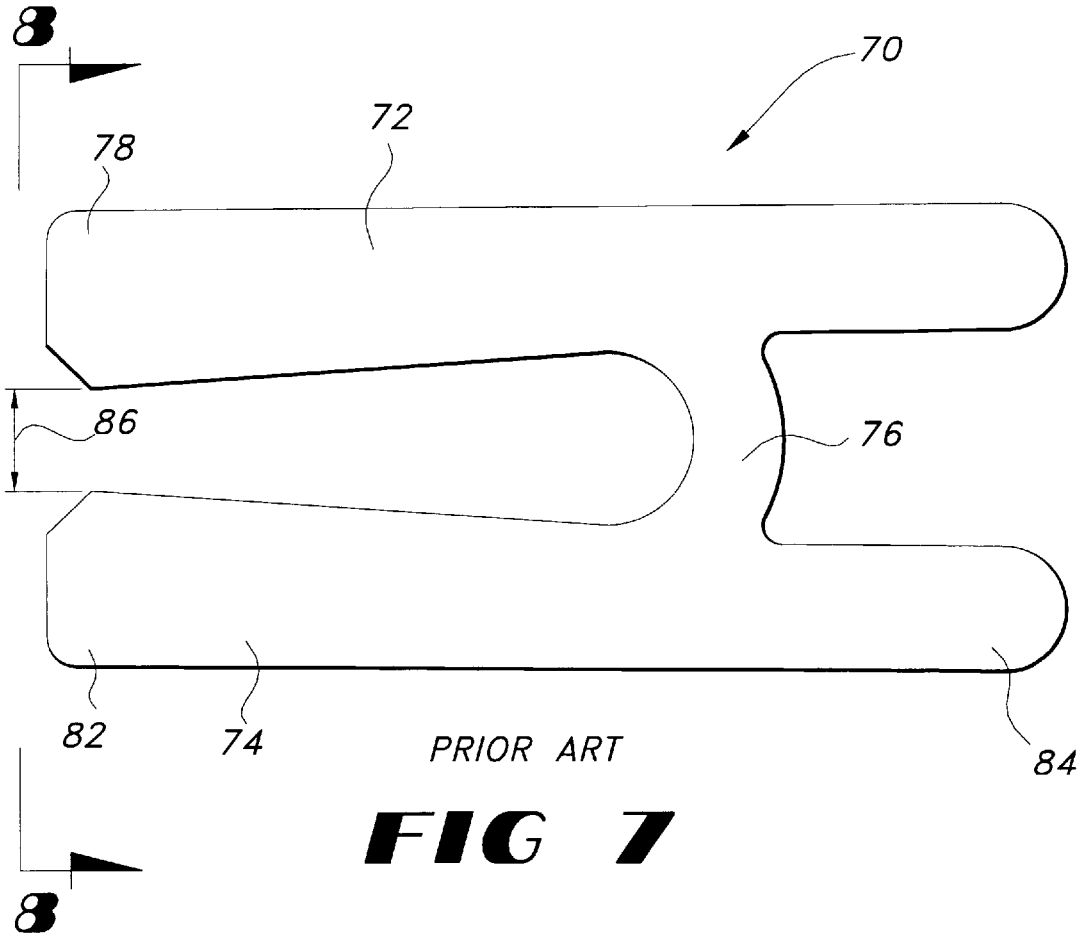
PRIOR ART FIG 7
FIG. 7 is a side elevation view of a prior art test clip.
Figure 8:
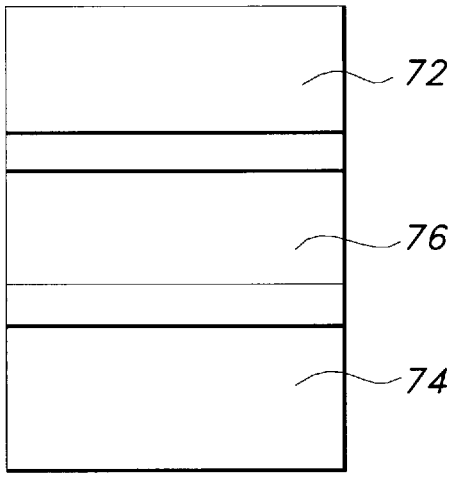
PRIOR ART FIG 8
FIG. 8 is a front end elevation view taken along line 8—8 in FIG. 7.

FIGS. 7 and 8 illustrate a prior art test clip 70 which may be used in conjunction with the subsequently described method of the present invention for balancing ceiling fan 10, or other ceiling fans. The test clip 70 is preferably made of a plastic material and includes an upper member 72, a lower member 74 and a connecting member 76 interconnecting the upper 72 and lower 74 members. The upper member 72 has a first end 78 and a second end 80, and the lower member 74 has a first end 82 and a second end 84. The upper member 72 and lower member 74 are spaced apart by a distance or spacing 86 having a minimum free-state value at a location proximate the first end 78 of member 72 and the first end 82 of member 74 as shown in FIG. 8. The minimum free-state value of spacing 86 is less than the thickness 66 of each blade 18. However, the spacing 86 may be increased between ends 78 and 82 by applying a compressive load to ends 80 and 84 of members 72 and 74, respectively, so that the test clip 70 may be releasably attached to one of the blades 18 for use with the method of the present invention as subsequently discussed. End 78 of member 72 and end 82 of member 84 apply a clamp load to the blade 18 to which clip 70 is attached, retaining clip 70 in position.

Figure 9:
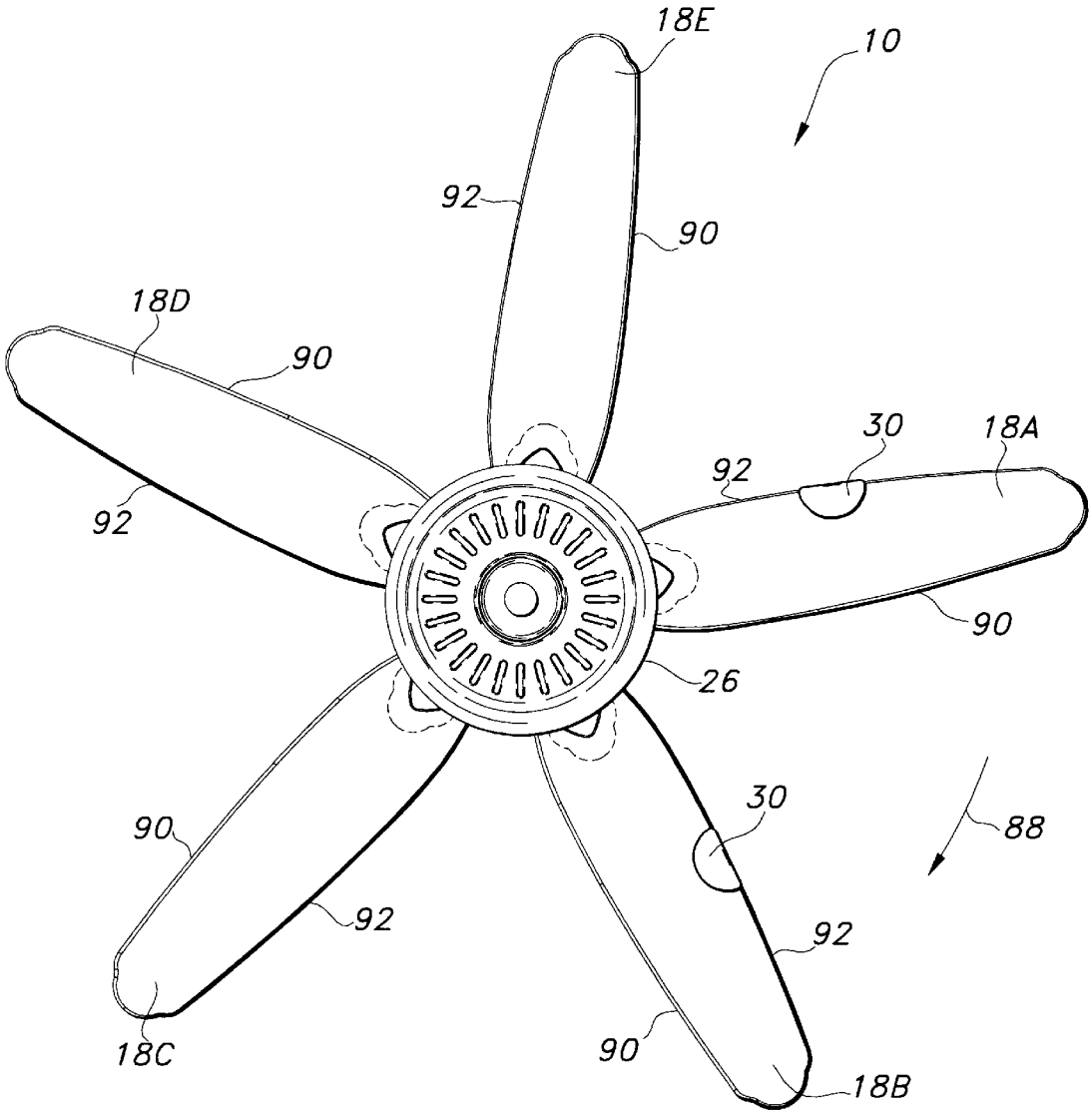
FIG. 9 is a top plan view of the fan shown in FIG. 1 illustrating a method step of the present invention using two of the test clips shown in FIGS. 2–6.
Figure 10:
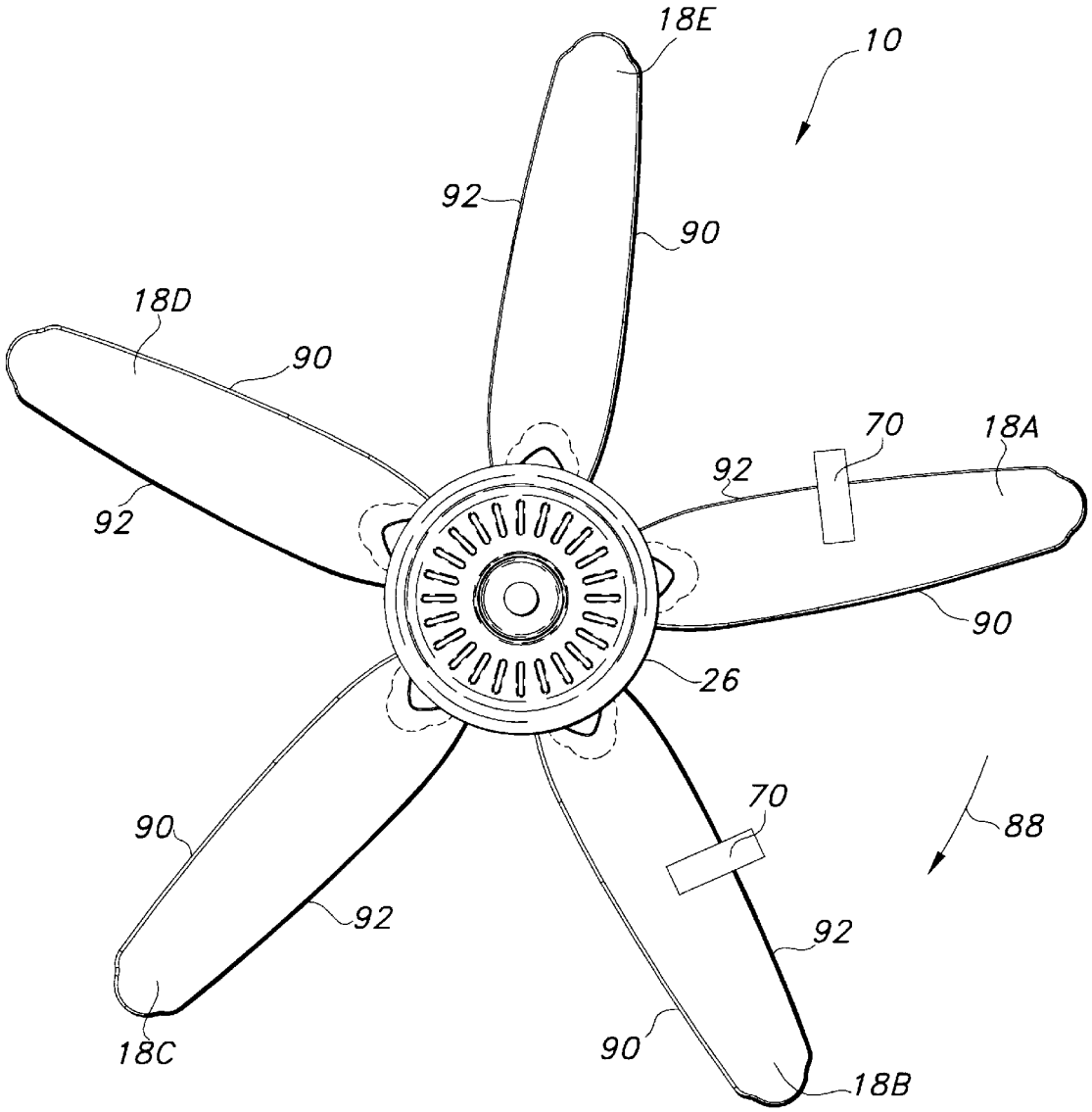
FIG. 10 is a view similar to that shown in FIG. 9 illustrating a method step according to the present invention using a pair of the alternative, prior art test clips shown in FIGS. 7–8.

The method steps of the present invention, for balancing a ceiling fan such as ceiling fan 10, may be better understood with reference to FIGS. 9–12. The method of the present invention may be used to significantly reduce, or substantially eliminate any wobble associated with the operation of ceiling fan 10. As shown in FIGS. 9–12, ceiling fan 10 includes five of the blades 18, which are designated as 18A through 18F. The initial step of the method of the present invention is to releasably attach a test clip 30 to each one of an adjacent pair of blades 18, with ceiling fan 10 stationary. This pair of blades 18 are selected arbitrarily. For purposes of illustration, a first one of the test clips 30 is releasably attached to blade 18A and a second test clip 30 is releasably attached to the adjacent blade 18B, as shown in FIG. 9. The test clips 30 are releasably attached to a mid-span position along blades 18A and 18B as shown in FIG. 9. Although the initial radial position of clips 30 may vary from the mid-span position, the pair of clips 30 are preferably positioned at approximately the same radial position.

The next steps are to operate the ceiling fan 10 on high speed in a downdraft direction with the test clips 30 attached to blades 18A and 18B, and to observe the wobble of fan 10. The downdraft direction comprises a clockwise rotation, indicated by arrow 88, when the fan 10 is viewed from above as shown in the top plan view of FIG. 9. Each of the blades 18 include a first edge 90 and a second edge 92. As may be appreciated, one of the edges 90 and 92 comprises a leading edge and the other comprises a trailing edge, depending upon the direction of rotation of fan 10. When ceiling fan 10 is operated in a downdraft direction, edge 90 comprises the leading edge and edge 92 comprises the trailing edge of each blade 18. The test clips 30 are preferably releasably attached to the blades 18 proximate the trailing edge 92 of the blades 18 so as to minimize the disruption to the airflow passing over the blades 18 and clips 30. Accordingly, in the previous steps, clips 30 are releasably attached to blades 18A and 18B proximate the trailing edge 92 of blades 18A and 18B.

Alternatively, test clips 70 may be used in lieu of test clips 30 with one of the clips 70 being releasably attached to blade 18A at a mid-span position proximate the trailing edge 92 of blade 18A and a second one of the clips 70 being releasably attached to blade 18B at a mid-span position proximate the trailing edge 92 of blade 18B. The fan may then be operated on high speed in the downdraft direction 88 with clips 70 attached to blades 18A and 18B. Although the remaining steps of the method of the present invention will be discussed and illustrated with respect to the test clips 30, it should be understood that the same steps may be used with clips 70, with the exception of the steps associated with the alignment or orientation of the edges 40 and 46 of clips 30.

The step of releasably attaching one of the test clips 30 to each one of an adjacent pair of the fan blades 18, preferably includes the steps of positioning each of the test clips 30 so that the substantially straight portion 52 of edge 40 of the upper member 32, and the substantially straight portion 56 of edge 46 of the lower member 34, of each of the test clips is substantially parallel to the trailing edge 92 of the corresponding blade 18, and the arcuate portions 54 and 58 of edges 40 and 46, respectively extend toward the leading edge 90 of the corresponding blade 18. This positioning, and the aerodynamic shape of test clips 30 minimizes the interruption to the airflow passing over blades 18 and test clips 30, as well as any vibrations associated with the airflow disruption. Accordingly, the use of test clips 30 may provide a more accurate determination of the optimum location to attach balance weights 94, as opposed to the use of prior art test clips which are not aerodynamically shaped and create a larger airflow disturbance and associated airflow-induced vibration.

Figure 11:
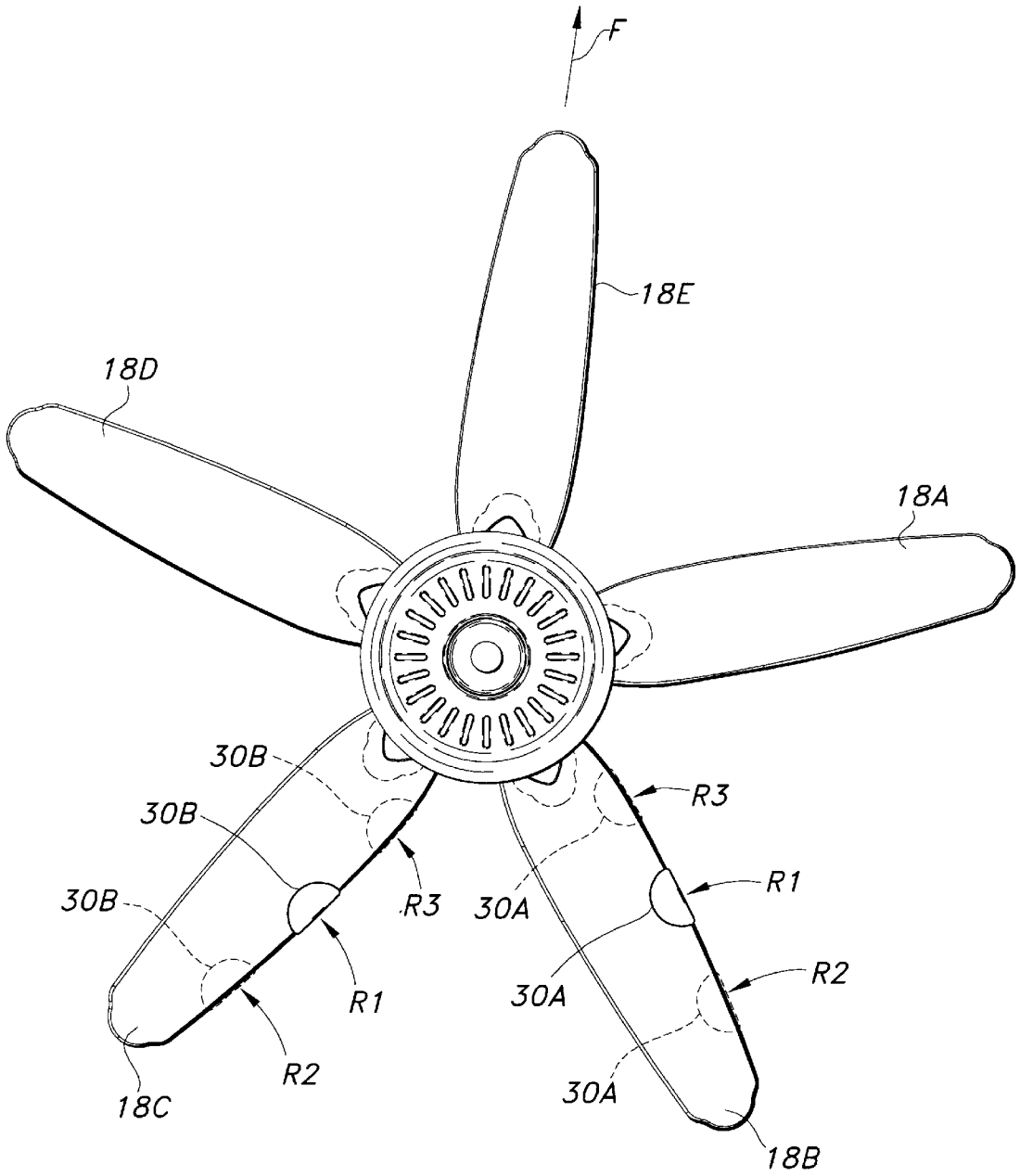
FIGS. 11 and 12 are top plan views of the fan shown in FIG. 1 further illustrating the method steps of the present invention.

The steps of releasably attaching one of the test clips 30 to each one of an adjacent pair of blades 18, operating the ceiling fan on high speed in a downdraft direction with the test clips attached and observing the ceiling fan wobble, are repeated for each adjacent pair of the fan blades 18. For instance, these steps will be repeated for the adjacent pairs of fan blades 18 corresponding to blades 18B and 18C, blades 18C and 18D, etc. After this procedure has been completed for each of the adjacent pairs of fan blades 18, the adjacent pair of blades 18 producing the minimum ceiling fan wobble is identified and the test clips 30 are releasably attached to this pair of blades 18. For instance, as shown in FIG. 11, blade 18F is a heavy blade producing an imbalance due to a differential centrifugal force F, depicted schematically in FIG. 11, as compared to the centrifugal force produced by each of the remaining blades 18. As may be appreciated by one skilled in the art, in this situation the observer would note that placement of the test clips 30 on the adjacent pair of blades 18B and 18C would produce the minimum ceiling fan wobble due to the position of blades 18B and 18C relative to blade 18F and the resultant centrifugal force vectoring. In other words, a component of the differential centrifugal force caused by attachment of one of the test clips 30 on blade 18B would offset a portion of force F, and a component of the differential centrifugal force caused by attachment of the other test clip 30 on blade 18C would substantially offset the remainder of force F.

The optimum radial position of clips 30 on blades 18B and 18C, with respect to wobble of ceiling fan 10, is then determined as follows. The first test clip, denoted as 30A, is positioned on blade 18B at a first radial position shown in solid line and indicated as R1 in FIG. 11. Radial position R1 may comprise the mid-span position on blade 18B or may be somewhat different. The second test clip 30, designated as 30B, is positioned at a first radial position shown in solid line and indicated as R1 on blade 18C. Again, the R1 position on blade 18C may correspond to the mid-span position. The ceiling fan 10 is again operated on high speed in a downdraft direction with the ceiling fan wobble being observed. One of the test clips, for instance, test clip 30A is then positioned to a second radial position. This radial position may either be radially outward or inward relative to position R1. For purposes of illustration, clip 30A is moved radially outward to a second radial position R2 shown in dashed line. Although the difference in radius between positions R1 and R2 may vary, this incremental radial distance may preferably be approximately be one quarter of the span of blade 18B. Again, the ceiling fan 10 is operated on high speed in a downdraft direction with the clip 30B remaining at position R1 and the ceiling fan wobble being observed. Test clip 30A is then repositioned to a third radial position, shown in dashed line and indicated as R3, which is radially inward of the first radial position R1 for purposes of illustration. However, it should be understood that the third position may be radially outward of position R2. The ceiling fan 10 is again operated on high speed in a downdraft direction, with test clip 30B remaining at position R1, and the ceiling fan wobble being observed. This process is repeated with test clip 30A being repositioned radially along the blade 18B and test clip 30B remaining at the original radial location R1, until the radial position of test clip 30A producing the minimum ceiling fan wobble has been identified. For purposes of illustration, it may be assumed that this position corresponds to position R2 on blade 18B.

The foregoing process is then repeated, by operating the ceiling fan on high speed in a downdraft direction with test clip 30A remaining at position R2, while test clip 30B is repositioned to a new radial position for each test operation of fan 10, such as positions R2 and R3 shown in dashed line, with the fan wobble being observed for each position of the test clip 30B. This process is repeated until the radial position of test clip 30B producing the minimum ceiling fan wobble, has been identified. For purposes of illustration, it may be assumed that this position corresponds to position R3 on blade 18C.

Figure 12:
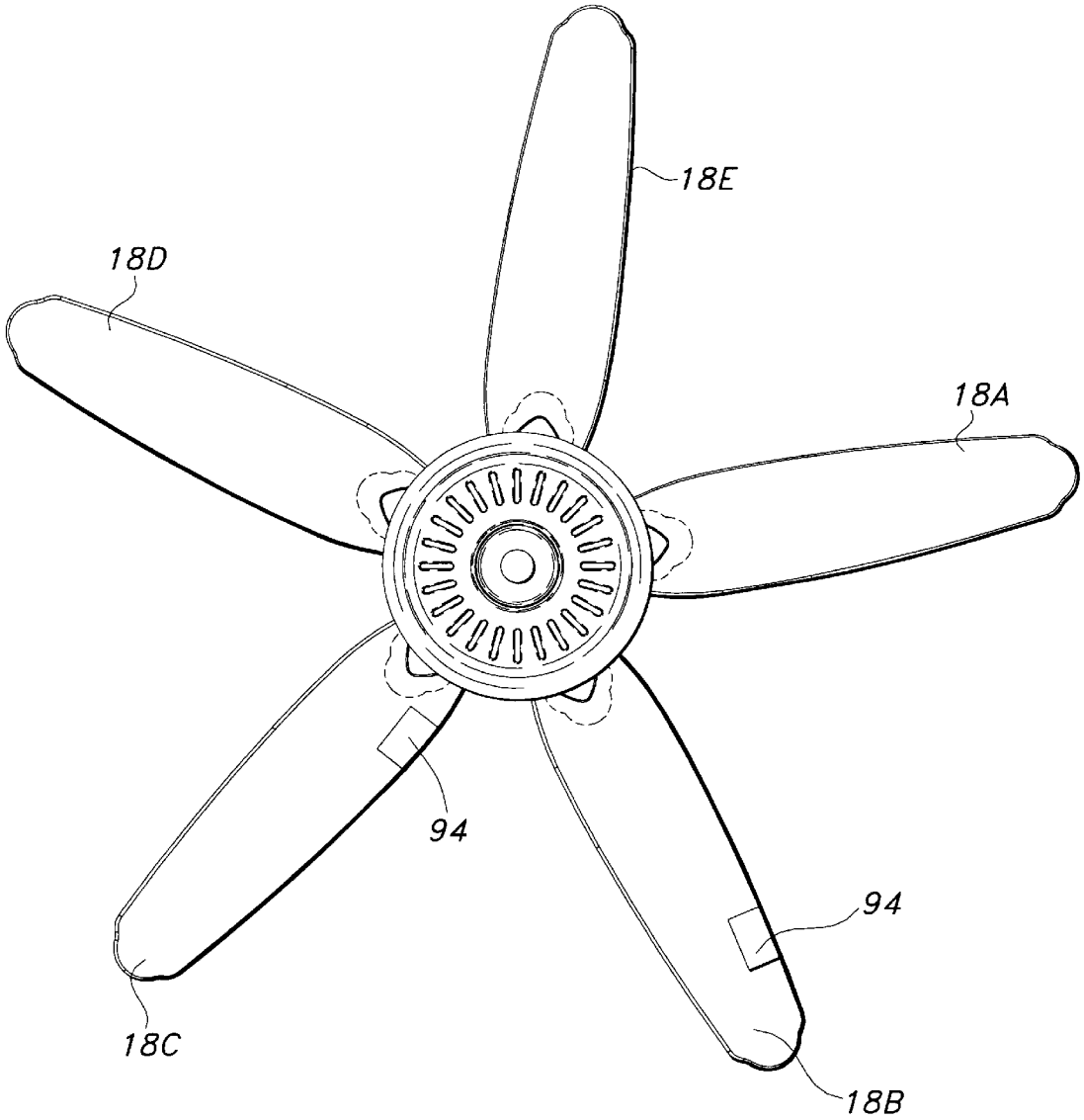

The test clips 30A and 30B are then removed, and replaced by a pair of self-adhesive balance weights 94 which are attached, by a bonding agent, to the top surface of blades 18B and 18C at the optimum radial position identified by testing the ceiling fan 10 with clips 30A and 30B. Accordingly, one of the balance weights 94 is attached to the upper surface of blade 18B at radial position R2, while the other of the balance weights 94 is attached to the top surface of blade 18C at radial position R3, as shown in FIG. 12, based on the assumptions noted in the foregoing illustrative discussion. It is important that each of the balance weights 94 has a weight which is substantially the same as the weight of one of the test clips 30. Furthermore, it is important that balance weights 94 are positioned proximate the trailing edge 92 of blades 18B and 18C, so that the positioning of weights 94 will be substantially the same as the optimum positions identified for test clips 30A and 30B. The balance weights 94 may comprise a substantially flat, substantially rectangular piece of a metal tape, such as a lead tape. The weights 94 include a bonding or adhering agent affixed to one side and covered with a protective covering such as wax paper, which may be removed prior to application of the balance weights 94 to the blades 18. This type of balance weight is known in the art. Other types of balance weights may be used, but they should have a relatively low profile, so as to minimize the disruption of airflow over the blades 18, and should be attached or adhered to the upper surface of the blades 18, so that they are not visible to an observer positioned below ceiling fan 10.

While the foregoing description has set forth the preferred embodiments of the present invention in particular detail, it must be understood that numerous modifications, substitutions and changes can be undertaken without departing from the true spirit and scope of the present invention as defined by the ensuing claims. The invention is therefore not limited to specific preferred embodiments as described, but is only limited as defined by the following claims.

What is claimed is:

1. A method for balancing a ceiling fan suspended from a ceiling, the ceiling fan having a plurality of rotatable fan blades, said method comprising the following steps:

acquiring at least two test clips;

releasably attaching at least one of the test clips to each one of an adjacent pair of the fan blades, with the ceiling fan being stationary;

operating the ceiling fan on high speed in a downdraft direction with the test clips attached to the adjacent pair of the fan blades;

observing the ceiling fan wobble during said operating step;

repeating said releasably attaching, operating and observing steps for each remaining adjacent pair of the fan blades;

identifying the adjacent pair of the fan blades producing the minimum ceiling fan wobble;

determining the optimum radial position of each of the test clips, with respect to ceiling fan wobble, on each blade of the identified adjacent pair of the fan blades;

replacing each of the test clips with a balance weight secured to the corresponding one of the identified adjacent pair of fan blades at the optimum radial position determined in said determining step.

2. The method as recited in claim 1, wherein said attaching step comprises the step of:

releasably attaching at least one test clip proximate a trailing edge of each one of the adjacent pair of the fan blades.

3. The method as recited in claim 1, wherein said attaching step comprises the steps of:

releasably attaching a first test clip proximate a trailing edge of one of the adjacent pair of the fan blades;

releasably attaching a second test clip proximate a trailing edge of the other of the adjacent pair of the fan blades.

4. The method as recited in claim 3, wherein said attaching step further comprises the steps of:

locating the first test clip at a mid-span position along the trailing edge of one of the adjacent pair of the fan blades;

locating the second test clip at a mid-span position along the trailing edge of the other of the adjacent pair of the fan blades.

5. The method as recited in claim 3, wherein said determining step comprises the steps of:

releasably attaching the first test clip to one of the identified adjacent pair of the fan blades at a first radial position proximate a trailing edge of the blade;

releasably attaching the second test clip to the other of the identified adjacent pair of the fan blades at a first radial position proximate a trailing edge of the blade;

repeating said operating and observing steps for each of a plurality of radial positions of the first test clip proximate the trailing edge of the one of the identified adjacent pair of the fan blades while leaving the second test clip at the first radial position on the other of the identified adjacent pair of the fan blades;

identifying the optimum radial position of the first test clip resulting in the minimum ceiling fan wobble;

repositioning the second test clip to at least one additional radial position proximate the trailing edge of the other of the identified adjacent pair of the fan blades;

repeating said operating and observing steps for each of the additional radial positions of the second test clip while leaving the first test clip at the optimum radial position resulting in the minimum ceiling fan wobble;

identifying the optimum radial position of the second test clip resulting in the minimum ceiling fan wobble.

6. The method as recited in claim 1, wherein said replacing step comprises the step of:

providing a plurality of the balance weights, each having a weight substantially equal to a weight of one of the test clips.

7. The method as recited in claim 1, wherein said replacing step comprises the step of:

adhering each of the balance weights to a top surface of one of the identified adjacent pair of the fan blades at the optimum radial position on each of the blades resulting in the minimum ceiling fan wobble.

8. A method for balancing a ceiling fan suspended from a ceiling, the ceiling fan having a plurality of rotatable fan blades, said method comprising the following steps:

releasably attaching at least one test clip to each one of an adjacent pair of the fan blades, with the ceiling fan being stationary;

operating the ceiling fan on high speed in a downdraft direction with the test clips attached to the adjacent pair of the fan blades;

observing the ceiling fan wobble during said operating step;

repeating said releasably attaching, operating and observing steps for each remaining adjacent pair of the fan blades;

identifying the adjacent pair of the fan blades producing the minimum ceiling fan wobble;

determining the optimum radial position of each of the test clips, with respect to ceiling fan wobble, on each blade of the identified adjacent pair of the fan blades;

replacing each of the test clips with a balance weight secured to the corresponding one of the identified adjacent pair of fan blades at the optimum radial position determined in said determining step;

wherein said attaching step comprises the steps of:

releasably attaching a first test clip proximate a trailing edge of one of the adjacent pair of the fan blades; and releasably attaching a second test clip proximate a trailing edge of the other of the adjacent pair of the fan blades;

wherein said first and second test clips each include an upper member, a lower member and a connecting member interconnecting the upper and lower members, the upper and lower members each having a peripheral edge including an arcuate portion and a substantially straight portion, wherein:

said step of releasably attaching the first test clip includes the step of positioning the first test clip with the substantially straight portions of the edges of the upper and lower members of the first test clip being substantially parallel with the trailing edge, and the arcuate portions of the edges of the upper and lower members of the first test clip extending toward the leading edge, of the one of the adjacent pair of the fan blades;

said step of releasably attaching the second test clip includes the step of positioning the second test clip with the substantially straight portions of the edges of the upper and lower members of the second test clip being substantially parallel with the trailing edge, and the arcuate portions of the edges of the upper and lower members of the second test clip extending toward the leading edge, of the other of the adjacent pair of the fan blades.

9. A test clip for use in balancing a ceiling fan suspended from a ceiling, the ceiling fan having a plurality of rotatable fan blades, each blade having a thickness, a leading edge and a trailing edge, said test clip comprising:

a generally D-shaped upper member having an upper surface, a lower surface and a peripheral edge extending between said upper and lower surfaces;

a generally D-shaped lower member having an upper surface, a lower surface and a peripheral edge extending between said upper and lower surfaces;

a connecting member interconnecting said upper and lower members, said connecting member defining a free-state spacing between said lower surface of said upper member and said upper surface of said lower member;

said upper and lower members and said connecting member being made of an elastic material and configured to permit said clip to be releasably attached to one of the blades proximate one of the leading and trailing edges of the blade.

10. The test clip as recited in claim 9, wherein:

said free-state spacing has a minimum value which is less than the thickness of each of the blades whereby said upper and lower members apply a clamp load to the one of the blades when said clip is releasably attached thereto.

11. The test clip as recited in claim 9, wherein:

said upper and lower members are substantially aligned with one another.

12. The test clip as recited in claim 9, wherein:

said connecting member is disposed proximate said edge of said upper member and said edge of said lower member.

13. The test clip as recited in claim 12, wherein:

said edge of said upper member includes an arcuate portion and a substantially straight portion;

said edge of said lower member includes an arcuate portion and a substantially straight portion;

said connecting member interconnects said substantially straight portions of said edges of upper and lower members.

14. The test clip as recited in claim 13, wherein:

said upper member has a maximum width;

said lower member has a maximum width;

said connecting member has a width which is less than one half of said maximum width of both of said upper and lower members.

15. The test clip as recited in claim 13, wherein:

said substantially straight portions of said edges of said upper and lower members are substantially aligned with one another and are substantially parallel with the trailing edge of the one of the blades when said test clip is releasably attached to the one of the blades.

16. The test clip as recited in claim 9, wherein:

said elastic material comprises a plastic material.

17. The test clip as recited in claim 9, wherein:

said upper member, said lower member, and said connecting member are made as a one-piece construction.

* * * * *